US005581322A

United States Patent [19]

Fyson

[11] Patent Number: 5,581,322

[45] Date of Patent: Dec. 3, 1996

[54] PHOTOGRAPHIC PROCESSING APPARATUS

[75] Inventor: John R. Fyson, Hackey, United Kingdom

[73] Assignee: Eastman Kodak Company, Rochester, N.Y.

[21] Appl. No.: 322,232

[22] Filed: Oct. 13, 1994

[30] Foreign Application Priority Data

Dec. 22, 1993 [GB] United Kingdom ..... 9326205

[51] Int. Cl.[6] ..... G03D 3/02; G03D 13/00

[52] U.S. Cl. ..... 396/578; 396/630

[58] Field of Search ..... 354/322, 323, 354/234, 298; 134/64 P, 64 R, 122 P, 122 R; 222/94, 129, 382; 366/142; 137/386

[56] References Cited

U.S. PATENT DOCUMENTS

| | | | |
|---|---|---|---|
| 3,206,074 | 9/1965 | Hoffmann | 222/94 |
| 4,227,818 | 10/1980 | Gacki et al. | 366/142 |
| 4,734,728 | 3/1988 | Müller | 354/324 |
| 4,972,220 | 11/1990 | Kastl et al. | 354/324 |
| 5,184,164 | 2/1993 | Kose et al. | 354/298 |

FOREIGN PATENT DOCUMENTS

| | | | |
|---|---|---|---|
| 0192282 | 8/1986 | European Pat. Off. | G03D 3/06 |
| 0422664A2 | 4/1991 | European Pat. Off. | G03D 3/13 |
| 5-40334 | 2/1993 | Japan | 354/324 |

*Primary Examiner*—D. Rutledge
*Attorney, Agent, or Firm*—J. Lanny Tucker

[57] ABSTRACT

A photographic processing machine has at least two processing tanks for holding different processing solutions and a removable container containing at least two working strength processing solutions in separate sub-containers. The sub-container which feeds the first used processing tank comprises a level detector. When the level falls to a predetermined limit, an indicator means is activated signaling the necessity for changing the processing solution container.

10 Claims, 3 Drawing Sheets

PHOTOGRAPHIC PROCESSING APPARATUS

FIELD OF THE INVENTION

This invention relates to photographic processing apparatus and to a method of determining when a batch of processing solution(s) need replacing.

BACKGROUND OF THE INVENTION

Many known small photographic processing machines are supplied with processing solutions by means of a cartridge or cassette of ready-made working strength solution(s). For example such a multiple cartridge could comprise a color developer solution, a bleach fix solution and two or three wash and/or stabilizer solutions. Such containers can also contain filter or treatment means. Often such cartridges are returned to the manufacturer for recycling or disposal.

It is not always clear when to replace the cartridge; too early would be wasteful while too late would cause the processing to go out of control and produce undesirable results. Merely counting the number of sheets or lengths processed and calculating the "worst case" scenario could result in leaving serviceable solutions in the container. Such a scenario, for example, might assume that every frame is fully exposed thus requiring maximum amounts of developer and bleach-fix.

SUMMARY OF THE INVENTION

According to the present invention there is provided a method of processing imagewise exposed photographic materials in a photographic processing machine having at least two processing tanks for holding different processing solutions and a removable container containing at least two working strength processing solutions in separate sub-containers therein from which the processing tanks are fed, wherein the sub-container which feeds the first processing tank comprises a solution level detector, and when the fluid level in the sub-container falls to a predetermined limit, an indicator means is activated signaling the necessity for changing the processing solution sub-container.

Additionally the present invention provides a photographic processing apparatus comprising at least two processing tanks for holding different processing solutions and a removable container containing at least two working strength processing solutions in separate sub-containers therein from which the processing tanks are fed, wherein the sub-container which feeds the first used processing tank comprises a solution level detector, and an indicator means provided on the apparatus, which is activatable by the level detector signaling the necessity for changing the processing solution container.

Moreover, the present invention provides a photographic processing solution cartridge comprising a container containing at least two working strength processing solutions in separate sub-containers therein, wherein one of the sub-containers comprises a level detector.

The processing solution container is changed neither too early nor too late thus saving waste in the former case and improving the quality of the processing in the latter, for example when the squeegees have deteriorated.

The present invention is particularly useful in a case where developer carry-over into the bleach-fix bath reduces the bleach-fixing activity of the solution.

DETAILED DESCRIPTION OF THE INVENTION

Figure 1:
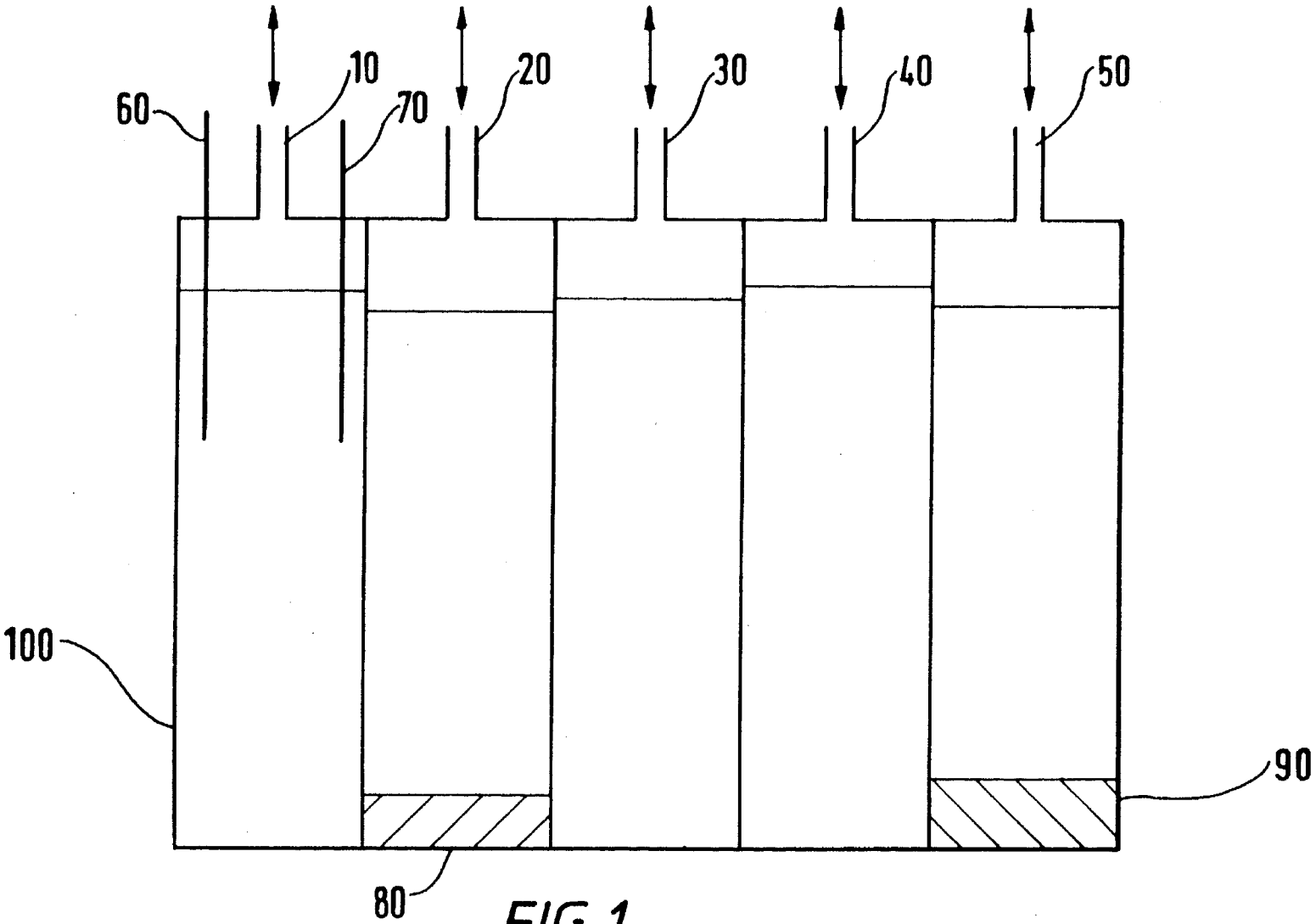
FIGS. 1 and 2 of the accompanying drawings show a multicontainer processing solution pack and FIG. 3 shows a plot illustrating the results of Example 3 below.

When loss by evaporation is small (which is usually the case in small processing machines or minilabs) particularly good results are obtained.

Provided that the loss from a processor tank due to evaporation is small compared to the volume carried over from one tank to the next, the loss from that container is equivalent to the amount added to the next bath. Applying this to the developer tank, when the level falls to a predetermined amount it would indicate that the second tank's contents are outside acceptable limits. The predetermined amount needs to be established by experiment.

It is preferred to locate the level detector in or on the sub-container, especially in the developer sub-container. The level detector maybe of any type with the following being preferred:

(a) Electrodes in the sub-container where an increase in resistivity would indicate lack of aqueous solution at the level of the electrodes, (b) A photo-detecting system, for example a photodiode emitter and a radiation-sensitive detector means, relying on total internal reflection or light transmission, or (c) A weighing system where a predetermined loss of weight could be detected.

The indicator means may be a bell, buzzer, light or other like means or, as in option 4 above, the level detector and indicator means may be combined as a mark on a transparent part of the sub-container that can be viewed by the operator.

Alternatively a totally or partially transparent container having a level mark visible to the operator could act as a combined level detector and indicator means.

The present invention is particularly applicable to small processing machines, especially those known as minilabs. Such machines are designed to be operated by someone without much knowledge of processing chemistry and are therefore as automatic as possible. A paper processing machine would normally comprise develop and bleach-fix tanks with one or more wash or stabilize tanks.

The process may comprise the steps of:

(a) color development, (b) bleach, (c) fix followed by one or more wash or stabilizer steps or a similar method in which the bleach and fix baths are combined into a single bleach-fix bath. Preferably a sub-container feeding a tank used after the image-forming step(s) contains activated charcoal or an ion-exchange resin or mixtures thereof to remove unwanted processing chemicals, for example, color developing agent.

In a particular embodiment the bleach-fix sub-container contains activated charcoal to remove unwanted color developer carry-over while the last stabilizer sub-container contains ion exchange resin or mixtures thereof. In particular a mixture of anionic and cationic ion exchange resins can be employed.

Alternatively the process may comprise the steps of:

(a) development, and (b) fix, followed by one or more wash or stabilizer steps. The developer would typically be a black-and-white developer.

A further alternative would be in the case of a redox amplification process in which the first bath is a redox amplification bath or, especially, a redox developer-amplifier bath. Such amplification processes are well known. Redox amplification processes have been described, for example in British Specification Nos. 1,268,126, 1,399,481, 1,403,418 and 1,560,572. In such processes color materials are developed to produce a silver image (which may contain only small amounts of silver) and then treated with a redox amplifying solution (or a combined developer-amplifier) to form a dye image.

The developer-amplifier solution contains a color developing agent and an oxidizing agent which will oxidize the color developing agent in the presence of the silver image which acts as a catalyst. Oxidized color developer reacts with a color coupler to form the image dye. The amount of dye formed depends on the time of treatment or the availability of color coupler and is less dependent on the amount of silver in the image as is the case in conventional color development processes.

Examples of suitable oxidizing agents include peroxy compounds including hydrogen peroxide and compounds which provide hydrogen peroxide, for example addition compounds of hydrogen peroxide; cobalt (III) complexes including cobalt hexammine complexes; and periodares. Mixtures of such compounds can also be used.

The materials to be processed and the processes to be used are described in Research Disclosure Item 308119, December 1989 published by Kenneth Mason Publications, Emsworth, Hants, United Kingdom.

Figure 2:
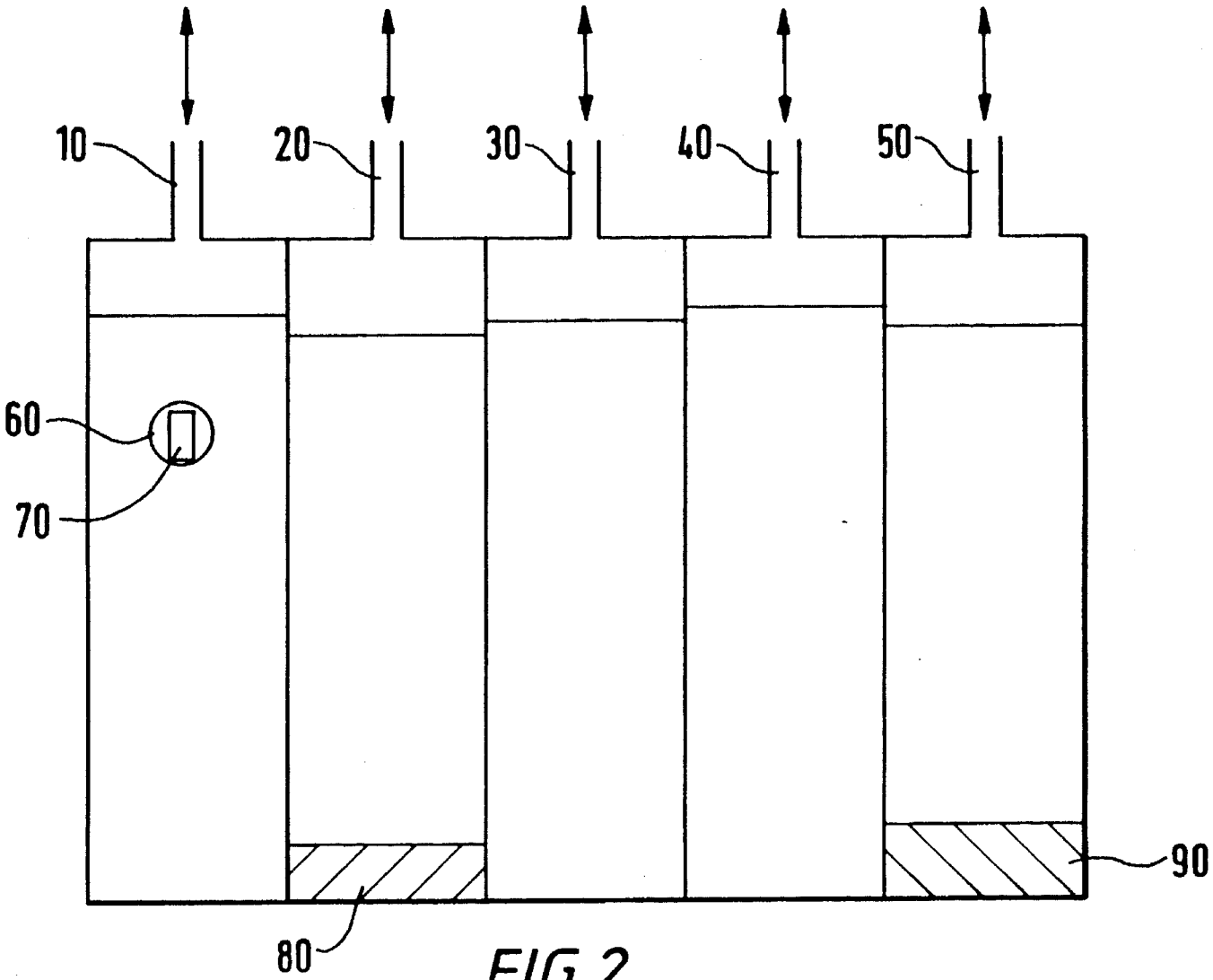

In the accompanying drawings, FIGS. 1 and 2 show schematically a removable container containing 4 working strength processing solutions in 5 separate sub-containers. Cartridge 100 contains sub-containers 10–50 which respectively contain the processing solutions: developer, bleach-fix, stabilizer, stabilizer and stabilizer. Each solution is supplied to the appropriate processing tank and returned via tubes by circulation means, for example, a pump, not shown. The level detection means comprises two electrodes 60 and 70 which stop showing a small resistance when the level of the liquid has fallen below the bottom end of the electrodes. This event can trigger the alarm. To extend the useful life of the container, the bleach-fix sub-container (20) contains activated charcoal 80 to remove developing agent while the last stabilizer sub-container contains ion-exchange resin (90) to remove ionic species carried over from previous baths.

FIG. 2 shows a similar cartridge which is fitted with a radiation detector and radiation source on the opposite side (not shown). This will trigger when the liquid falls below the level of the detector.

The bleach-fix sub-container contains activated charcoal to remove unwanted color developer carry-over while the second stabilizer sub-container contains ion exchange resin or mixtures thereof.

The following Example is included for a better understanding of the invention.

EXAMPLE

Figure 3:
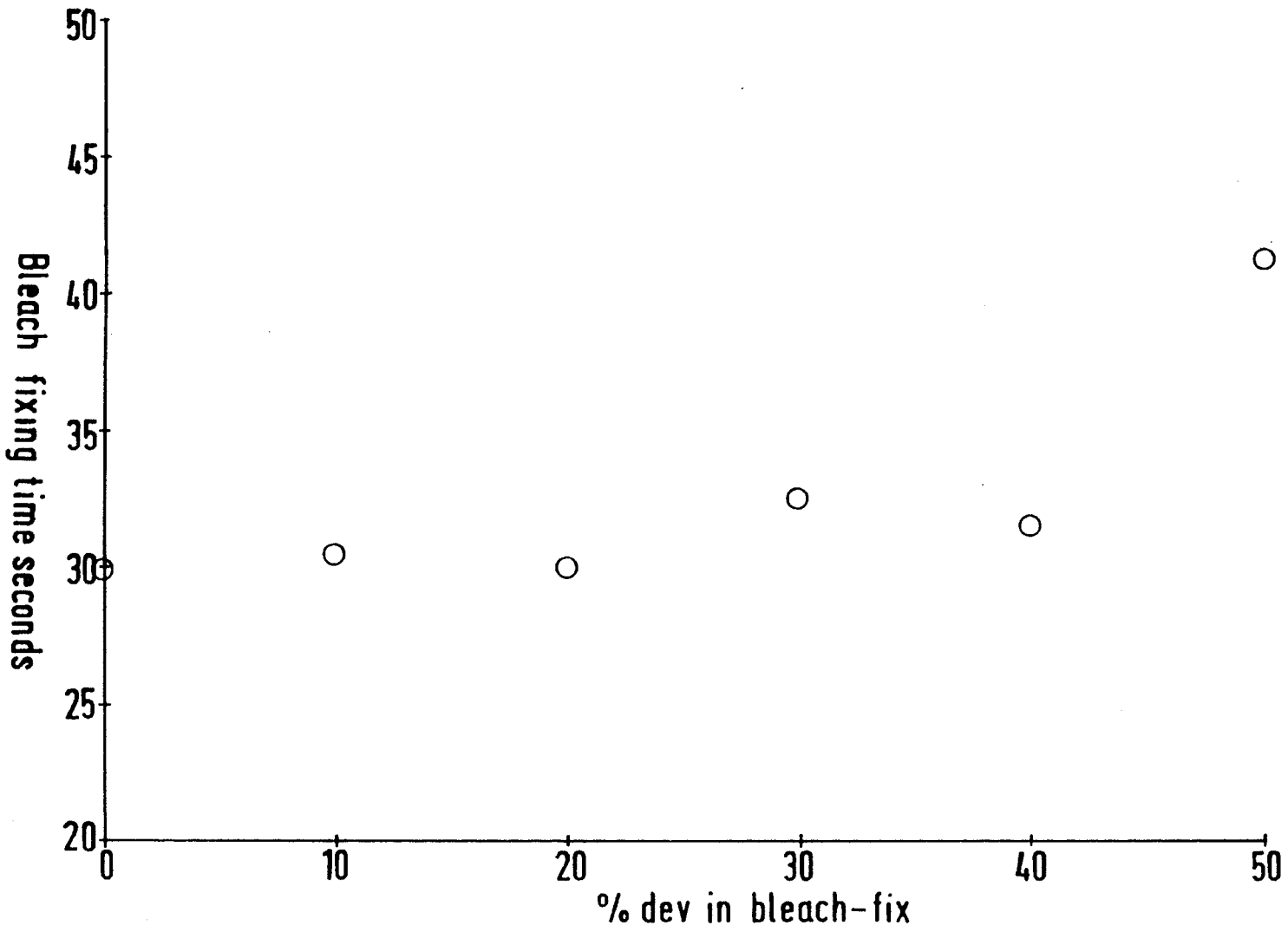

The bleach-fixing time of EKTACOLOR EDGE paper was determined in EKTACOLOR RAbleach-fix NR contaminated with different amounts of EKTACOLOR RA developer. The experiment was carried out by developing a long fogged length of EDGE paper for 45seconds at 35° C., then stopping it in 5% acetic acid followed by a 2 minute wash. The bleach-fixing time of this was determined by observing the infra red density of the material in the bleach-fix solution in a transparent cell designed for the purpose. This has been described in *J. Phot. Sci* 32 (1984) 235–244. Amounts of the bleach-fix were used to which different amounts of the developer had been added. The results are shown in FIG. 3 of the accompanying drawings. It can be seen that the bleach-fix time is beginning to exceed 35 seconds, the aim time for the processor, after 40% developer had been added. This indicates the end of the usefulness of the bleach fix solution.

If the cartridges illustrated in FIGS. 1 and 2 have 500 ml developer and bleach-fix portions, the level sensors should be set to indicate when the developer level has fallen by 200 ml. This would imply that the bleach-fix was approaching being 40% developer, the point at which it has been determined to have failed to function sufficiently well.

The invention has been described in detail with particular reference to preferred embodiments thereof, but it will be understood that variations and modifications can be effected within the spirit and scope of the invention.

I claim:

1. A method of processing imagewise exposed photographic materials in a photographic processing machine having at least two processing tanks for holding different processing solutions, a removable container containing at least two working strength processing solutions in separate sub-containers therein from which said processing tanks are supplied, and a circulating means for circulating each of said processing solutions to and from each respective pair of tanks and corresponding sub-containers, wherein only said sub-container which feeds the first processing tank comprises a solution level detector, and when fluid level in said sub-container falls to a predetermined limit, an indicator means is activated signaling the necessity for changing the processing solution sub-container.

2. The method of claim 1 which comprises the steps of:

(a) color development, (b) bleach, (c) fix followed by one or more wash or stabilizer steps or a similar method in which the bleach and fix baths are combined into a single bleach-fix bath.

3. The method of claim 1 which comprises the steps of:

(a) development, (b) fix, followed by one or more wash or stabilizer steps.

4. The method of claim 1 in which the first bath is a redox amplification bath or a redox developer-amplifier bath.

5. A photographic processing apparatus comprising at least two processing tanks for holding different processing solutions, a removable container containing at least two working strength processing solutions in separate sub-containers therein from which the processing tanks are supplied, and a circulating means for circulating each of said processing solutions to and from each respective pair of tanks and corresponding sub-containers, wherein the sub-container which feeds the first used processing tank comprises a solution level detector, and an indicator means provided on said apparatus, which is activatable by said level detector signaling the necessity for changing the processing solution container.

6. The processing apparatus of claim 5 which comprises four processing tanks and in which the container comprises four sub-containers.

7. A photographic processing solution cartridge comprising a container containing at least two working strength processing solutions in separate sub-containers therein, wherein only one of said sub-containers comprises a processing solution level detector.

8. The photographic processing solution cartridge of claim 7 in which said level detector comprises:

(a) electrodes in a sub-container for indicating a lack of aqueous solution at the level of the electrodes from an increase in conductivity, (b) a photo-detecting system comprising a photoiode emitter and a radiation-sensitive detector means, (c) a weighing system for detecting a predetermined loss of weight, or, as a combined level detector and indicator means (d), a totally or partially transparent container having a level mark visible to the operator.

9. The photographic processing solution cartridge of claim 7 which contains activated charcoal in a bleach-fix or fix sub-container.

10. The photographic processing solution cartridge of claim 7 wherein the last wash or stabilizer sub-container contains an ion-exchange resin or mixtures thereof.

* * * * *